United States Patent [19]

Adler

[11] Patent Number: 4,679,788

[45] Date of Patent: Jul. 14, 1987

[54] EXERCISE DEVICE

[76] Inventor: David M. Adler, 1301 N.E. 191 St., North Miami Beach, Fla. 33141

[21] Appl. No.: 803,420

[22] Filed: Dec. 2, 1985

[51] Int. Cl.[4] ..... A63B 21/00

[52] U.S. Cl. ..... 272/93; 272/122; 272/900

[58] Field of Search ..... 272/93, 122, 123, 900, 272/117

[56] References Cited

U.S. PATENT DOCUMENTS

| | | | |
|---|---|---|---|
| 3,134,592 | 5/1964 | Sharkey | 272/58 |
| 3,826,490 | 7/1974 | Mossman | 272/117 |
| 3,966,200 | 6/1976 | Kirk | 272/109 |
| 4,116,434 | 9/1978 | Bernstein | 272/93 |
| 4,227,271 | 10/1980 | Kulka | 5/443 |
| 4,252,316 | 2/1981 | Price | 272/123 |
| 4,440,391 | 4/1984 | Saenz, Jr. et al. | 272/93 |
| 4,468,022 | 8/1981 | Wu | 272/93 |
| 4,515,361 | 5/1985 | Mellilo et al. | 272/93 |
| 4,550,907 | 11/1985 | Mellilo et al. | 272/93 |
| 4,601,464 | 7/1986 | Mousel | 272/900 X |

*Primary Examiner*—Richard J. Apley
*Assistant Examiner*—J. Welsh
*Attorney, Agent, or Firm*—Oltman and Flynn

[57] ABSTRACT

An exercise device having a weighted and padded cross arm on a post extending up from the base of the device. The base has a channel-shaped front end for snugly engaging the foot of a bed mattress. The base has a flat bottom segment extending rearward from its channel-shaped front end and a flat back segment hinged to the back end of the bottom segment.

16 Claims, 13 Drawing Figures

Fig. 1
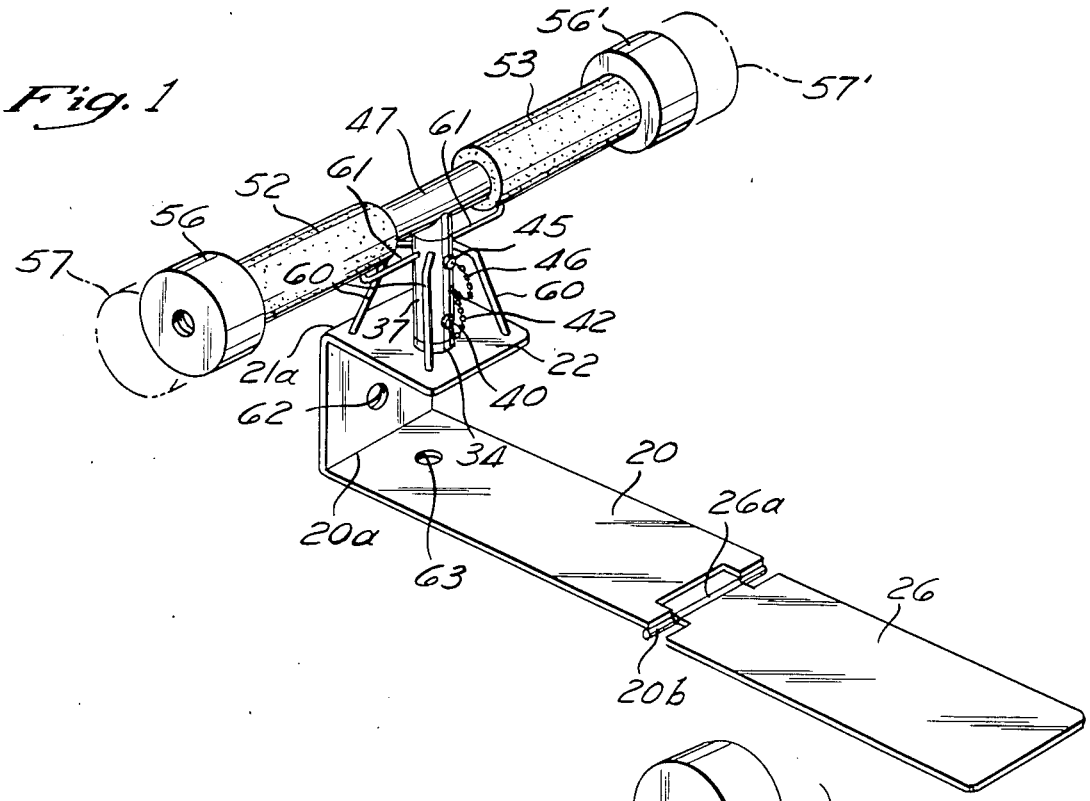
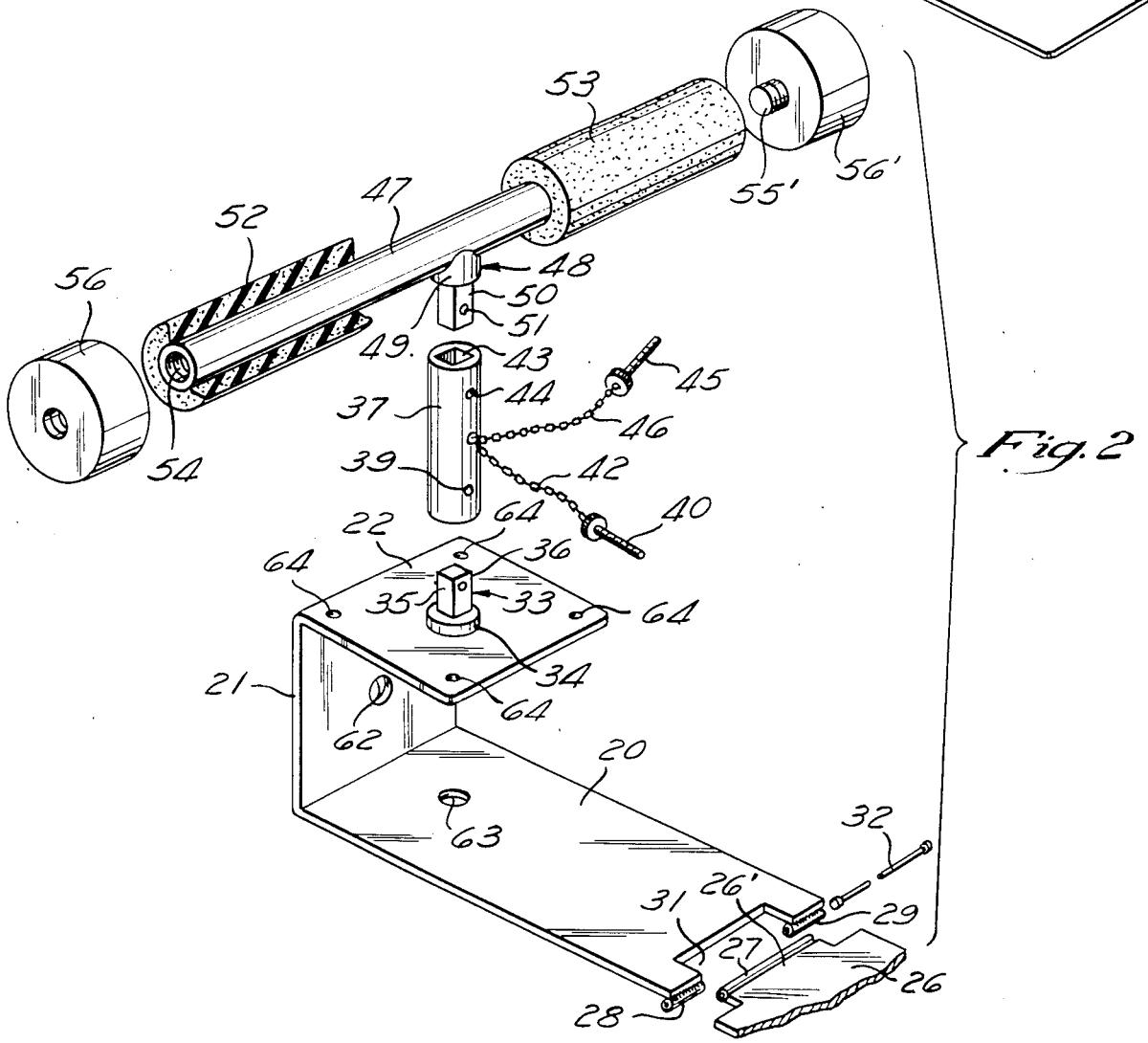
Fig. 2

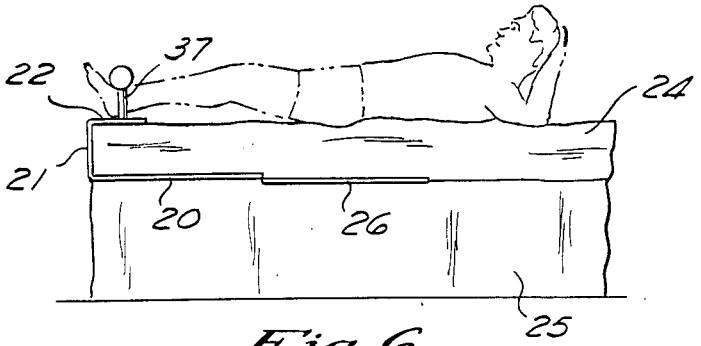
Fig. 6
Fig. 7
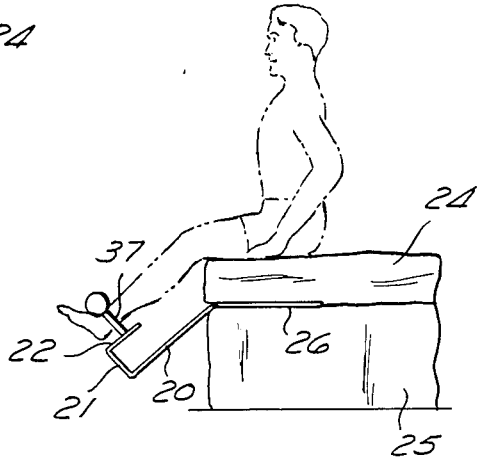
Fig. 8
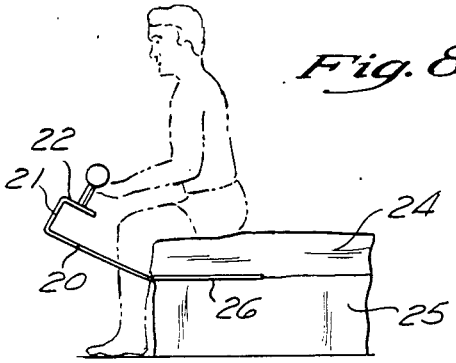
Fig. 9
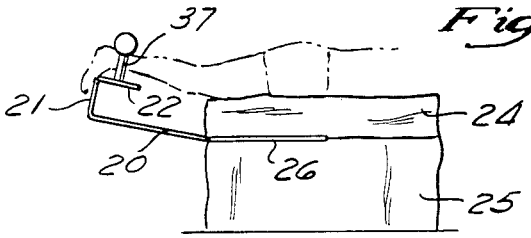
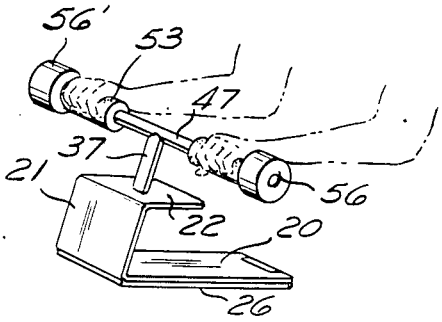
Fig. 10
Fig. 11
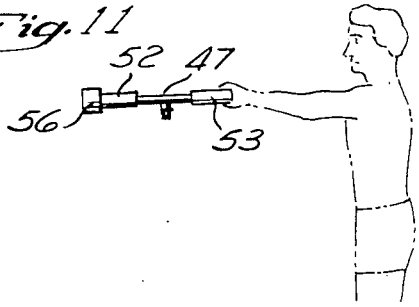
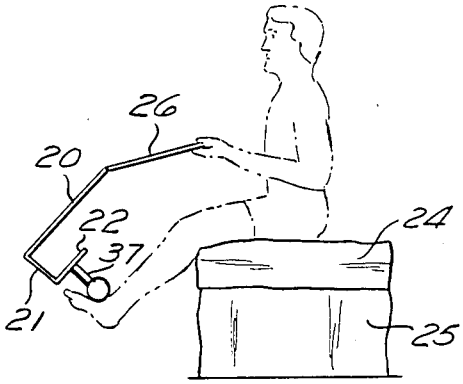
Fig. 12
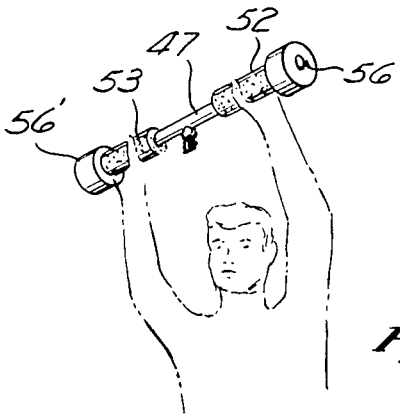
Fig. 13

EXERCISE DEVICE

SUMMARY OF THE INVENTION

This invention relates to an exercise device for use in the home.

Various relatively elaborate exercise machines on the market today are designed to enable the user to perform several different types of exercises, such as sit ups, presses, leg curls and leg extensions. Such machines take up considerable floor space and do not lend themselves to truly compact storage when not in use. At the other extreme are various single-purpose or limited-purpose exercise devices, such as sit-up bars, push-up bars, and hand-held weights for jogging. These devices may be compact but they are not versatile.

The present invention is directed to a novel exercise device which is both versatile and adapted for compact storage, so that it is ideal for use in a person's bedroom. It can be applied to the mattress of a bed for use by a person performing sit-ups, leg extensions, bicep curls or leg curls. It can be removed from the mattress and used in performing wrist curls, bench presses (in which the person may lie on the mattress), exercising the calf muscles by raising and lowering the toes (preferably while sitting on the bed), and other exercises.

A principle object of this invention is to provide a novel exercise device which has great versatility, enabling many different exercises to be performed yet takes up little room and can be stored very compactly.

Further objects and advantages of this invention will be apparent from the following detailed description of a presently preferred embodiment, shown in the accompanying drawings.

DESCRIPTION OF THE DRAWINGS

FIG. 1 is a perspective view of the present invention;

FIG. 2 is an exploded perspective view showing the components of the present exercise apparatus disassembled, with parts broken away for clarity;

FIG. 6 is an elevational view taken from the left side of the bed and showing a person positioned to do sit-ups, using the present exercise apparatus to hold his feet down;

FIG. 7 is a similar view showing the present exercise apparatus partly pulled out from the mattress to a position in which the person sitting on the mattress can do leg extensions to exercise the thigh muscles;

FIG. 8 shows the exercise apparatus in the same position relative to the mattress but with the user doing bicep curls;

FIG. 9 shows the exercise apparatus in the same position relative to the mattress as in FIGS. 7 and 8, but with the user lying face down on the mattress and doing leg curls;

FIG. 10 is a fragmentary perspective view of the present apparatus with the bottom of its base folded and with the user doing wrist curls;

FIG. 11 is an elevation showing a person using the present exercise apparatus to strengthen arm muscles used in a forehand tennis stroke;

FIG. 12 is an elevation showing a person sitting on the mattress and using the present exercise apparatus to exercise his calf muscles; and FIG. 13 shows a person lifting the weighted cross arm of the present exercise apparatus above the head.

DETAILED DESCRIPTION

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

Figure 5:
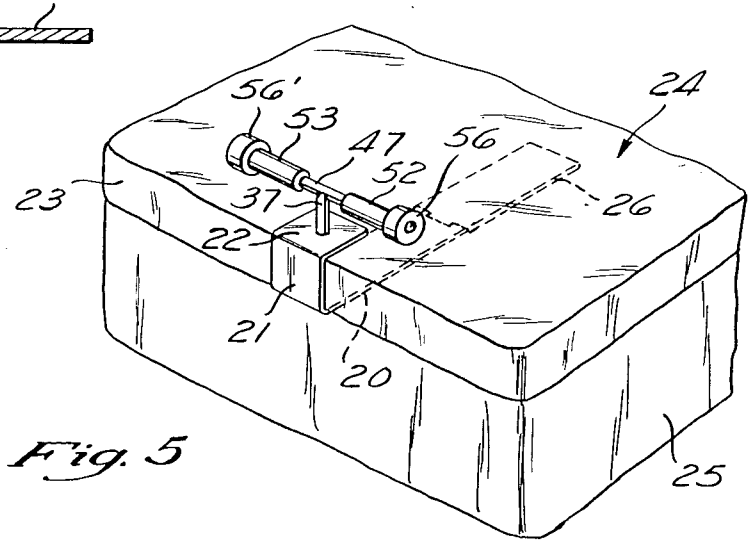
FIG. 5 is a perspective view showing the foot of a mattress and box spring on which the present exercise device is mounted for sit-ups by a person on the mattress.

Referring to FIG. 1, the present exercise apparatus has a substantially rigid base with an elongated, thin, flat, rectangular bottom segment 20, a thin, flat, rectangular front segment 21 rigidly joined to the bottom segment 20 at its front end **20*a* and extending perpendicular to it, and a thin, flat, rectangular top segment 22 joined to the front segment 21 at its upper end 21*a* and extending from it parallel to and above the bottom segment 20. The top segment 22 has a substantially shorter length (i.e., the dimension away from the front segment 21) than the bottom segment 20. Preferably, the segments 20, 21 and 22 of the base constitute an integral one-piece structure of metal, plastic, or fiber-reinforced plastic. Alternatively, they may be plywood pieces rigidly connected by angle braces where they adjoin one another. The front segment 21, the top segment 22 and the front part of the bottom segment 20 together form a rectangular channel which, as shown in FIG. 5, is dimensioned to fit snugly on the foot end 23 of a bed mattress 24 overlying a box spring 25. The bottom segment 20** is sandwiched between the top of the box spring and the bottom of the mattress.

As shown in FIG. 1, the base also has a thin, flat, elongated, rectangular back segment 26 whose front end **26*a* is hingedly connected to the back end 20*b* of the bottom segment 20 of the base such that these two segments of the base can be adjusted pivotally through a range of virtually 360 degrees with respect to each other. When the base is positioned with its channel-shaped front end embracing the foot end of the mattress 24, as shown in FIG. 5, the back segment 26 preferably extends directly rearward from and in alignment with the front segment 20. Alternatively, the base of the apparatus may be folded up as shown in FIG. 10** before being applied to the mattress.

As shown in FIG. 2, the back segment 26 has a rectangular projection 26' on its front end which carries an elongated cylindrical sleeve or eye 27. The bottom segment 20 at its back end has cylindrical sleeves or eyes 28 and 29 on opposite sides of a rectangular recess 31, which is aligned with and slightly larger than the front end projection 26' on the back segment 26. A hinge pin 32 extends through the sleeves 29, 27 and 28 to couple the back segment 26 pivotally to the front segment 20. The recess 31 in the bottom segment 20 provides clearance for the front end projection 26' on the back segment 26 so that the back segment can be folded upward toward the padded cross arm 47. The back segment 26 also can be folded flat beneath the bottom segment 20, as shown in FIG. 10.

As shown in FIG. 2, a short stub 33 extends up from the top segment 22 of the base. This stub has a cylindrical lower segment 34 joined to the top segment of the base and an upper segment 35 of smaller rectangular cross-section extending up from the lower segment 34. The upper segment 35 of stub 33 has a cross bore 36 extending through it from one side to the opposite side.

Figure 3:
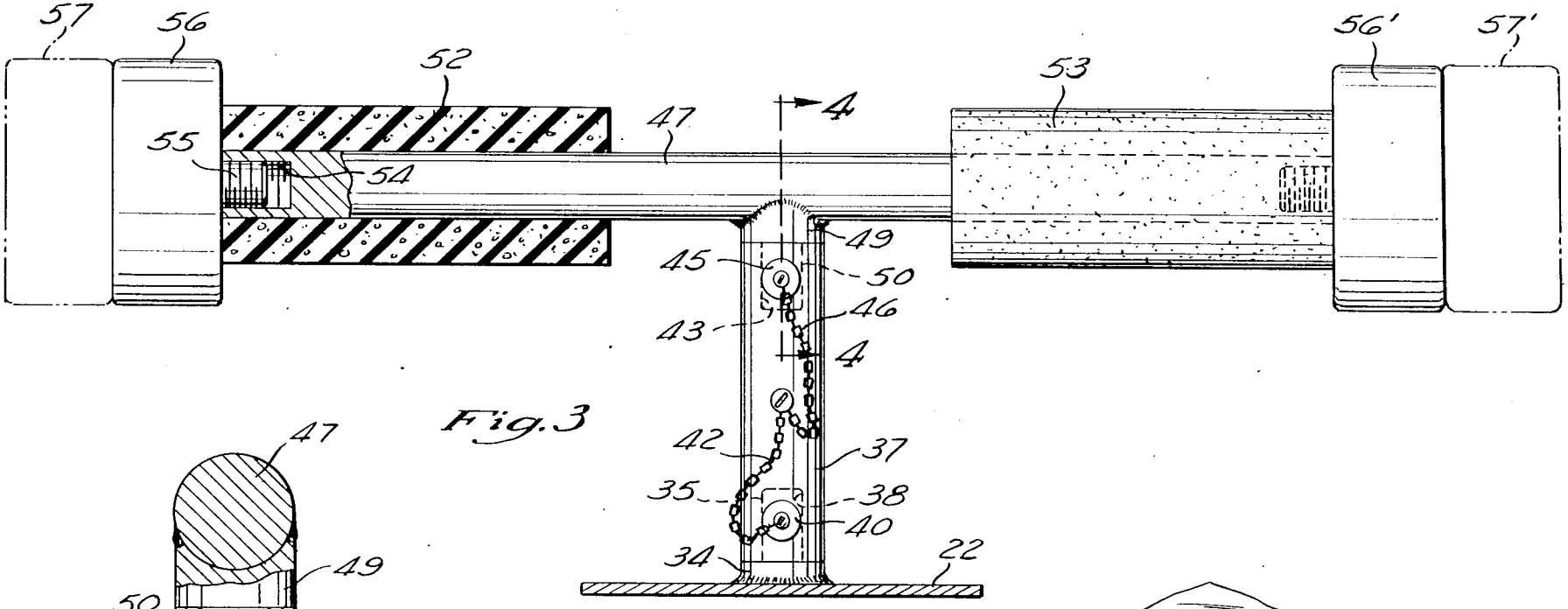
FIG. 3 is an elevational view, with parts broken away for clarity, showing the post, the padded cross arm, and weights on the ends of the cross arm in this apparatus.

A post 37 with a circular periphery has a rectangular recess 38 in its lower end (FIG. 3) which snugly but slidably receives the upper segment 35 of stub 33. Toward its lower end the post 37 has a pair of diametrically opposed, screw-threaded lower openings 39 (FIG. 2) which intersect the recess 38 and register with the opposite ends of the bore 36 in the stub when the post fits on top of the stub, as shown in FIG. 3. A screw-threaded lower bolt 40 (FIG. 2) is threadedly receivable in the screw-threaded post openings 39 and it is snugly but slidably receivable in the stub bore 36 when the post 37 fits on top of stub 33. This bolt is on the lower end of a flexible chain 42, the upper end of which is attached to the post 37 about midway up the post.

At its upper end the post 37 has a rectangular recess 43 and a pair of diametrically opposed, screw-threaded upper openings 44 on opposite sides of this recess. A screw-threaded upper bolt 45 is attached to post 37 by a flexible chain 46. This bolt is screw-threadedly receivable in the upper openings 44 in the post.

Figure 4:
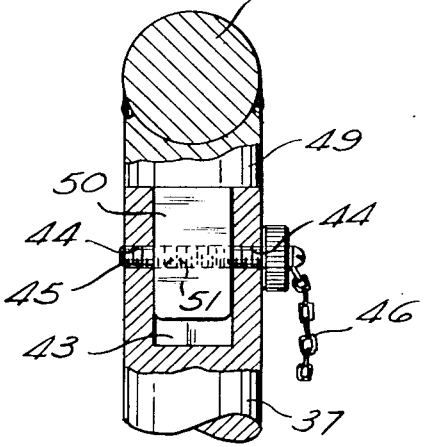
FIG. 4 is a fragmentary vertical cross-section taken along the line 4—4 in FIG. 3 and showing how the cross arm is detachably bolted to the post.

The exercise apparatus has an elongated cross arm 47 with a cylindrical periphery. This cross arm extends above and parallel to the top segment 22 of the base and its direction of elongation is parallel to the front segment 21 of the base. Midway along its length this cross arm has a downwardly projecting stub 48 with a cylindrical segment 49 welded to the bottom of the cross arm and a lower segment 50 of smaller rectangular cross section which fits snugly but slidably in the recess 43 in the upper end of post 37. Stub segment 50 has a cross bore 51 that registers with the upper post openings 44 when this stub segment is seated in the post recess 43. As shown in FIG. 4, the upper bolt 45 passes snugly but slidably through the stub cross bar 51 and is threadedly received in the upper post openings 44 at the opposite ends of this cross bore when the parts are assembled.

With this arrangement, the post 37 is detachably mounted on the base, with the lower end of the post resting on top of the cylindrical lower segment 34 of the stub 33 extending up from the top segment 22 of the base, and the cross arm 47 is detachably mounted on top of the post 37, with the bottom of the cylindrical segment 49 of cross arm stub 48 resting on top of the post. The bolts 40 and 45 lock the parts in this assembled position.

The cross arm 47 carries elongated cylindrical sleeves 52 and 53 of suitable cushioning material on opposite sides of the post 37. These sleeves may be of foam rubber or soft, resilient, foamed plastic material.

As thus far described, the apparatus preferably is of chrome plated steel.

At its left end in FIG. 3, the cross arm 47 has a screw-threaded socket 54 which threadedly receives a complementary screw-threaded stub 55 on a cylindrical weight 56. In this manner, the weight 56 is detachably mounted on this end of the cross arm. One or more additional weights 57 may be attached to the first weight 56, such as by providing a screw-threaded socket in the outer end of each weight to receive a screw-threaded stub on the adjacent end of the next weight, similar to the socket 54 in cross arm 47 and the stub 55 on the first weight 56.

One or more similar weights 56' and 57' are attachable to the opposite end of cross arm 47 in the same fashion.

As shown in FIG. 2, the front segment 21 of the base has a screw-threaded hole 62 for threadedly receiving the screw-threaded stub on a weight like the ones shown at 56 and 56' in FIGS. 2 and 3.

Likewise, the bottom segment 20 has an identical screw-threaded hole 63 for the releasable attachment of such a weight.

As shown in FIG. 1, the assembly of the post and the cross arm to the base is reinforced by several upper and lower rigid braces. In the embodiment shown there are four lower braces 60, each fixedly mounted at its upper end on post 37 and extending out from the post and bent downward and extending down to the top segment 22 of the base, where they are received in holes 64 drilled part-way into the top segment 22. These lower braces 60 engage the post 37 and the top segment 22 of the base at 90 degree intervals circumferentially around the post. As shown, there are two generally L-shaped upper braces 61 fixedly mounted on the post 37 diametrically opposite each other and each extending out from the post horizontally beneath the cross arm 47 and then bent upward to engage the cross arm from below, passing through bottom openings in the cushion sleeves 52 and 53 and into openings in the bottom of the cross arm 47.

FIG. 5 shows the present exercise apparatus mounted on the foot of a bed with the top segment 22 of its base resting on top of the mattress 24, front segment 21 extending across the foot end of the mattress, and the bottom and back segments 20 and 26 of the base engaged between the bottom of mattress 24 and the top of box spring 25. Single weights 56 and 56' are mounted on the opposite ends of the cross arm 47. However, there may be a greater number of such weights or none at all, depending upon the user's preference.

As shown in FIG. 6, a person lies on the mattress with his ankles beneath the cross arm pads 52 and 53, the back of his heels resting on the top segment 22 of the base, and his feet extending up past the cross arm 47 near the foot end of the mattress. The padded cross arm holds his feet down at the ankles, so he can do proper sit-ups on the mattress without raising his feet.

To exercise the thigh muscles, the user may adjust the position of the apparatus so that only the back segment 26 of its base is sandwiched between the box spring and the mattress, as shown in FIG. 7. This leaves the bottom segment 20 free to pivot up and down. The user sits on the mattress with his ankles engaged beneath the padded cross arm 47 in the same fashion as for sit-ups. The user raises and lowers his legs to exercise the thigh muscles. The weights on the ends of the cross arm oppose the lifting of the legs, and the user can put as much weight on the cross arm as is suitable for his muscular development.

If desired, to perform this exercise the user may remove the back segment 26 from beneath the mattress and place it on top of the mattress and then sit directly on it while doing the exercise.

FIG. 8 shows the exercise apparatus in the same position on the bed but with a person using it to do bicep curls. The user's hands grasp the weighted cross bar and his feet engage the floor just beyond the foot of the bed.

If desired, this exercise may be done with the back segment 26 of the base on top of the mattress instead of beneath it, as shown in FIG. 8, in which case the user would sit directly on segment 26.

FIG. 9 shows the exercise apparatus in the same position on the bed as in FIGS. 7 and 8, but with the user lying stomach-down on the mattress and with the backs of the legs behind the ankles engaging the padded cross bar from below. The user pivots the legs about the knees to raise and lower the cross bar, which carries appropriate weights on its opposite ends, to exercise the hamstring muscles. To do this exercise, instead of positioning the back segment 26 of the base beneath the mattress it may be put on top of the mattress with the user lying directly on top of it.

FIG. 10 shows this exercise device used for arm exercises. Preferably, for this exercise the back segment 26 is folded beneath the bottom segment 20 of the base. A suitable manually releasable fastener arrangement, such as a snap fastener (not shown), is provided to hold the back segment 26 substantially flush against the bottom segment. The user may sit on the bed with his hands over the top of the cross arm 47 to perform wrist curls.

FIG. 11 shows the exercise apparatus being used to strengthen the muscles used in hitting a forehand shot in tennis. A weight is attached to one end only of the padded cross bar. The other side of the padded cross bar is grasped in a fashion similar to that used on a tennis racquet. Muscles used in golf and baseball may be similarly strengthened.

FIG. 12 shows the exercise apparatus used in the performance of leg extensions. The user's feet engage the weighted and padded cross bar 47 from below at the ankles. The base pivots at the hinge between the back segment 26 and the bottom segment 20 of the base as the user raises and lower his legs.

If desired, the user may keep his heels inches from the floor and raise and lower his toes to raise and lower the weighted cross bar and thereby exercise the calf muscles.

FIG. 13 shows the cross bar assembly having been detached from the remainder of the apparatus and now being lifted above the head, or pressed. All of the exercises traditionally performed with a barbell or dumbbell can be performed with the cross bar assembly thus detached.

From the foregoing, it is evident that this exercise device is designed to be utilized in a room containing a bed, whether it be bedroom, hotel room, or hospital room, with the user being positioned comfortably on the bed of many of the exercises. Presence of the apparatus would encourage and promote physical conditioning by the robust and less robust alike, for high repetition, low weight exercises can be performed while in bed. The apparatus is versatile in function, for all major muscle groups can be strengthened by its usage. The versatility of the apparatus is further exhibited by the fact that its relatively light weight system makes it well suited for use by children and senior citizens, yet it is also well suited for use by the most muscular individuals in order to maintain muscle tone. The device can be easily disassembled for compact storage, shipment, or carrying to various locations.

I claim:

1. An exercise device comprising:

a substantially rigid base having an elongated flat bottom segment adapted to extend beneath a bed mattress, a front segment attached to and extending transverse to said bottom segment at one end thereof, and a top segment attached to said front segment in spaced relation to said bottom segment and extending from said front segment substantially parallel to said bottom segment, said bottom, front and top segments together forming a channel-shaped structure dimensioned to fit snugly on the end of a bed mattress;

a post structure extending transverse to said top segment of the base in a direction away from said bottom segment of the base; and a cross arm structure coupled to said post structure in spaced relation to said top segment of the base, said cross arm structure extending substantially parallel to said top segment of the base and substantially parallel to said front segment of the base and spaced from said top segment enough to permit a user's legs adjacent the ankles to fit between said cross arm structure and said top segment;

said base also having a flat back segment hingedly connected to said bottom segment at the opposite end of the latter from said front segment.

2. An exercise device comprising:

a substantially rigid base having an elongated flat bottom segment adapted to extend beneath a bed mattress, a front segment attached to and extending transverse to said bottom segment at one end thereof, and a top segment attached to said front segment in spaced relation to said bottom segment and extending from said front segment substantially parallel to said bottom segment, said bottom, front and top segments together forming a channel-shaped structure dimensioned to fit snugly on the end of a bed mattress;

a post structure extending transverse to said top segment of the base in a direction away from said bottom segment of the base;

a cross arm structure coupled to said post structure in spaced relation to said top segment of the base, said cross arm structure extending substantially parallel to said top segment of the base and substantially parallel to said front segment of the base and spaced from said top segment enough to permit a user's legs adjacent the ankles to fit between said cross arm structure and said top segment;

cushion material on the outside of said cross arm structure; and weights attached to said cross arm structure.

3. An exercise device according to claim 2 wherein said weights are detachably connected to the opposite ends of said cross arm structure.

4. An exercise device according to claim 3 wherein said base also has a flat back segment hingedly connected to said bottom segment at the opposite end of the latter from said front segment.

5. An exercise device according to claim 4 and further comprising means detachably connecting said post structure to said top segment of the base.

6. An exercise device according to claim 5 and further comprising means detachably connecting said cross arm structure to said post structure.

7. An exercise device according to claim 6, wherein:

said front segment of the base has a screw-threaded opening therein for the releasable attachment of a weight having a screw-threaded stub;

and said bottom segment of the base has a screw-threaded opening therein for the releasable attachment of a weight having a screw-threaded stub.

8. An exercise device comprising:

a substantially rigid base having an elongated flat bottom segment adapted to extend beneath a bed mattress, a front segment attached to and extending transverse to said bottom segment at one end thereof, and a top segment attached to said front segment in spaced relation to said bottom segment and extending from said front segment substantially parallel to said bottom segment, said bottom, front and top segments together forming a channel-shaped structure dimensioned to fit snugly on the end of a bed mattress;

a post structure extending transverse to said top segment of the base in a direction away from said bottom segment of the base;

a cross arm structure coupled to said post structure in spaced relation to said to segment of the base, said cross arm structure extending substantially parallel to said top segment of the base and substantially parallel to said front segment of the base and spaced from said top segment enough to permit a user's legs adjacent the ankles to fit between said cross arm structure and said top segment;

and weights attached to said cross arm structure.

9. An exercise device according to claim 8 wherein said weights are detachably connected to the opposite ends of said cross arm structure.

10. An exercise device according to claim 9 wherein:

said front segment of the base has a screw-threaded opening therein for the releasable attachment of a weight having a screw-threaded stub.

11. An exercise device according to claim 9 wherein:

said bottom segment of the base has a screw-threaded opening therein for the releasable attachment of a weight having a screw-threaded stub.

12. An exercise device comprising:

a substantially rigid base having an elongated flat bottom segment adapted to extend beneath a bed mattress, a front segment attached to and extending transverse to said bottom segment at one end thereof, and a top segment attached to said front segment in spaced relation to said bottom segment and extending from said front segment substantially parallel to said bottom segment, said bottom, front and top segments together forming a channel-shaped structure dimensioned to fit snugly on the end of a bed mattress;

a post structure extending transverse to said top segment of the base in a direction away from said bottom segment of the base; and a cross arm structure coupled to said post structure in spaced relation to said top segment of the base, said cross arm structure extending substantially parallel to said top segment of the base and substantially parallel to said front segment of the base and spaced from said top segment enough to permit a user's legs adjacent the ankles to fit between said cross arm structure and said top segment;

said front segment of the base having a screw-threaded opening therein for the releasable attachment of a weight having a screw-threaded stub.

13. An exercise device comprising:

a substantialy rigid base having an elongated flat bottom segment adapted to extend beneath a bed mattress, a front segment attached to and extending transverse to said bottom segment at one end thereof, and a top segment attached to said front segment in spaced relation to said bottom segment and extending from said front segment substantially parallel to said bottom segment, said bottom, front and top segments together forming a channel-shaped structure dimensioned to fit snugly on the end of a bed mattress;

a post structure extending transverse to said top segment of the base in a direction away from said bottom segment of the base;

a cross arm structure coupled to said post structure in spaced relation to said top segment of the base, said cross arm structure extending substantially parallel to said top segment of the base and substantially parallel to said front segment of the base and spaced from said top segment enough to permit a user's legs adjacent the ankles to fit between said cross arm structure and said top segment;

means detachably connecting said post structure to said top segment of the base;

cushioning material on the outside of said cross arm structure;

and weights detachably connected to said cross arm structure.

14. An exercise device according to claim 13 wherein:

said front segment of the base has a screw-threaded opening therein for the releasable attachment of a weight having a screw-threaded stub;

and said bottom segment of the base has a screw-threaded opening therein for the releasable attachment of a weight having a screw-threaded stub.

15. An exercise device comprising:

a substantially rigid base having an elongaged flat bottom segment adapted to extend beneath a bed mattress, and a front segment attached to and extending transverse to said bottom segment at one end thereof, and an elongated flat back segment hingedly connected to said bottom segment at the opposite end of the latter from said front segment for selective adjustment between a position extending rearward from said bottom segment as a substantially coplanar extension and a position folded forwardly against said bottom segment;

and a cross arm structure supported from said front segment of the base in a spaced parallel relation to said bottom segment of the base in a position permitting a user's legs adjacent the ankles to fit beneath said cross arm structure when said bottom segment of the base is beneath a bed mattress and said front segment extends up across one end of the bed mattress and the user is lying on said bed mattress.

16. An exercise device according to claim 15 and further comprising weights detachably connected to the opposite ends of said cross arm structure.

* * * * *